US005468167A

United States Patent [19]

Givens

[11] Patent Number: 5,468,167

[45] Date of Patent: Nov. 21, 1995

[54] LIFE RAFT UTILITY TETHER

[76] Inventor: James A. Givens, 3198 Main Rd., Tiverton, R.I. 02878

[21] Appl. No.: 282,479

[22] Filed: Jul. 29, 1994

[51] Int. Cl.[6] ..... B63B 35/58

[52] U.S. Cl. ..... 441/40; 441/84; 114/125

[58] Field of Search ..... 441/35, 40, 41, 441/42, 84, 85; 114/125, 345, 230

[56] References Cited

U.S. PATENT DOCUMENTS

| | | | |
|---|---|---|---|
| 2,722,696 | 11/1955 | Johnson . | |
| 2,959,278 | 11/1960 | Mitchell et al. | 441/42 |
| 3,216,030 | 11/1965 | Garfield . | |
| 3,843,983 | 10/1974 | Tangen | 441/40 |
| 3,883,913 | 5/1975 | Givens . | |
| 4,001,905 | 1/1977 | Givens . | |
| 4,280,239 | 7/1981 | Brown . | |
| 4,355,987 | 10/1982 | Miller | 441/42 |
| 4,499,844 | 2/1985 | Parish . | |
| 4,523,913 | 6/1985 | Kaino . | |
| 4,678,443 | 7/1987 | Edwards | 441/40 |
| 4,790,784 | 12/1988 | Givens . | |
| 4,890,569 | 1/1990 | Givens . | |
| 4,986,785 | 1/1991 | Flowers . | |

FOREIGN PATENT DOCUMENTS 677203 12/1963 Canada .

*Primary Examiner*—Stephen Avila

*Attorney, Agent, or Firm*—Burns, Doane, Swecker and Mathis

[57] ABSTRACT

A utility tether for a life raft, includes a tether having a plurality of links for securing a person to the tether. The tether is stored outside the canister of the inflatable raft to be accessible before deployment of the life raft. The tether includes means for linking persons on board a vessel in distress to the tether before the life raft is deployed and subsequently inflated. The links comprise adjustable loops that are cinched about a wrist or chest. Persons entering the water are thus tied to the life raft, which aids the secured persons in reaching the life raft to board even in rough water or winds. The tether alternatively includes flotation devices and lighting devices attached in conjunction with the links. The tether also includes a control line for manipulating a raft stabilizing bag to control for the effects of current and wind on the raft.

25 Claims, 5 Drawing Sheets

LIFE RAFT UTILITY TETHER

FIELD OF THE INVENTION

The present invention relates to safety devices for harnessing survivors to a life raft and to assist in control of the life raft.

BACKGROUND AND SUMMARY OF THE INVENTION

Inflatable life rafts are typically packed in a buoyant container or canister and equipped with an automatic inflating device. Generally, a painter line is attached to the raft and connects the raft to the main vessel. In addition, during deployment the painter triggers a device to inflate the raft. The raft canister is thrown into the water from a vessel in distress and, after a predetermined length of the painter line has been pulled from the canister, the life raft inflates. Persons on the main vessel are expected to enter the water and make their way to the raft by swimming or grasping and pulling their way along the painter line.

Painter lines generally have a length in a range of 65 to 150 feet to allow sufficient line for the raft to stand clear of the deploying vessel for safety reasons, for example, if a dangerous condition such as a fire exists on the vessel. In addition, the length of painter line allows the raft to deploy and inflate on its own in the event the vessel sinks without adequate warning to permit launching the raft.

While a painter line will keep the raft tied to the vessel, the raft will frequently, from the effect of wind or waves, move away from the main vessel the fully extended length of the painter line, i.e., the 65 to 150 foot length. In rough water or strong winds, this distance can be extremely difficult to cross to reach the raft. A person in the water can attempt to grasp the painter line to pull toward the raft, but, in rough water, it is difficult to maintain hold of a line. In cold weather, the shock of entering the water and the cold that immediately attacks the hands and limbs may prevent a person from being able to grasp or pull the painter line at all.

Painter lines are attached to the vessel by a weak point or breakaway point to allow the raft to free itself from a sinking vessel. Should the weak point breakaway in rough water or high winds, the unconstrained raft may be blown away from the survivors, preventing them from ever reaching the raft and safety.

The present invention, generally, provides a safety device for an inflatable raft that links persons on a vessel to the raft before the raft is deployed, and allows the raft to be deployed in a conventional manner, so that the linked persons may reach the raft safely after entering the water.

The persons linked to the device are also linked to each other, which allows those able to assist, for example, infants, children, non-swimmers, or others having difficulty.

More particularly, the present invention provides an inflatable life raft having an automatic inflating device and a separate tether device to link persons to the life raft.

According to a preferred embodiment, the present invention provides an inflatable life raft safety apparatus that includes a hollow canister having a front end and an opposite rear end and an inflatable life raft contained within the canister. The inflatable life raft includes at least an inflatable flotation platform for carrying at least one occupant. The flotation platform comprises a buoyant member forming a periphery and a floor spanning an interior space bounded by the inflated peripheral buoyant member, the floor being supported by the peripheral member, and a stabilizing bag positionable below the flotation platform when inflated, the stabilizing bag having a plurality of openings to fill with water. A raft inflating device includes a painter line having a first end and a second end, the first end being attached to the flotation platform and the second end extending out of the first end of the canister attachable to a vessel, an intermediate point of the line attached to means for triggering a compressed gas source to inflate the life raft. The painter line has a predetermined length that is pulled from the canister before the compressed gas source is triggered.

According to an alternative embodiment of the invention, an additional trigger line is attached to the inflation trigger and extends to a handle accessible outside of the canister for manually triggering inflation of the raft. The additional trigger line is vital in, for example, situations where the painter line is somehow both fouled in the canister and tangled with a structure on the vessel, preventing the painter line from triggering the inflation means and preventing the release of the painter line from the attachment point on the vessel. In such a situation, the sinking vessel can take the canister and unopened life raft under. The additional trigger line can be used to inflate the raft, which opens the canister and free the painter line. The survivors can cut the painter line to free the raft from the vessel, or rely on the buoyancy of the raft to break the attachment point of the painter to the raft if the vessel begins to pull the raft under water.

A survival tether is attached to the flotation platform at a first end and has a free second end. The tether extends from a rear end of the canister, that is, the end opposite to the painter line end, and has a predetermined length that is storable internally or externally to the canister. The tether includes means for securing at least one person to the tether, such as adjustable loops to grasp a wrist or snap hooks to hook to a life jacket or survival suit. Upon deployment of the life raft, at least one person may be secured to the tether so that when the life raft inflates in the water, the person is linked to the life raft to maintain contact with the life raft when the person enters the water.

According to an alternative embodiment of the invention, the tether is also linked to the automatic inflation device to trigger inflation of the life raft by pulling the tether out of the canister, so that either the tether or the painter line will trigger the inflation device. The tether-actuated trigger is useful on vessel, such as motor-powered yachts, where there is little or no danger of a mast or fishing nets or other obstruction of the vessel damaging the inflated life raft, to permit actuation by the survivors on the tether.

According to a particular embodiment of the present invention, the means for securing a person to the tether includes a plurality of spaced apart adjustable loops attached along the tether for cinching about a body part of a person, for example, around a wrist or chest, to secure the person to the tether.

According to another aspect of the invention, a first loop is positioned from the first end of the tether a sufficient distance to provide a first portion of the tether of sufficient length to permit the canister to be deployed in the water while at least one person linked to the tether remains on the vessel. That is, the tether is sufficiently elongated so that the raft may be thrown in the water, clearing the freeboard of the main vessel, and inflated before the persons on the tether are forced to enter the water.

According to an alternative embodiment of the invention, the means for securing at least on person to the tether may also comprise a plurality of spaced apart snap hooks for attaching to a ring on a survival suit. According to yet another alternative, the securing means may comprise a safety harness to secure the person's body to the tether.

According to yet another aspect of the invention, the tether may be equipped with inflatable buoyant devices attached to the tether in conjunction with the linking means to support a person in the water.

According to still another aspect, the tether may include a lighting signal device attached to the elongated tether in conjunction with the linking means so that the position of the link, and the person attached to the link, may be signalled by a light.

The tether according to the present invention may also include a shark or fish repellent in a releasing device attached to the tether in conjunction with the linking means.

According to yet another aspect of the invention, an auxiliary supplies canister is attached to the tether to carry extra food, water, tools, or other equipment useful for surviving on a raft. Life rafts typically include a supply pack having rations for a few days. The supply pack is contained within the canister and is packed when the life raft is packed in the canister. The auxiliary canister provides storage for additional gear to augment the supply pack and may be packed for each trip. The auxiliary canister is formed to float and may also serve as a flotation device for a person linked to the tether.

Another aspect of the invention includes means extending from the tether for controlling a stabilizing bag attached beneath the flotation platform. The stabilizing bag includes a plurality of holes that allow the bag to fill with water when the raft is deployed, the mass of water in the bag stabilizing the raft against overturning in rough water or strong winds. The bag, however, is subject to water currents and will cause the raft to travel with the current. To allow the raft to float free of current, for example, to take advantage of winds blowing in a direction other than the current, the tether includes a control line extending from the tether below the stabilization bag and attached to the raft at a bottom portion of the bag, or on the flotation platform, or another convenient location, wherein lifting the control line forces water from the openings in the stabilizing bag allowing the bag to collapse against the bottom surface of the raft platform. The control line may be positioned through loops attached to the stabilization bag to maintain the control line in a desired position. The control line may conveniently comprise one or more branching lines to support the stabilization bag for lifting.

According to another aspect of the invention, the control line further comprises a webbing attached to the stabilizing bag to distribute upward force by the control line across a lower surface of the stabilizing bag to facilitate emptying water from the bag.

The bag may be partially emptied so that it is shaped as a keel beneath the raft. In this way, the raft can be "sailed" by allowing the raft canopy to act as a sail and the keel-shaped bag to act to steer the moving raft.

BRIEF DESCRIPTION OF THE DRAWING FIGURES

The present invention can be further understood with reference to the following description in conjunction with the appended drawings, wherein like elements are provided with the same reference numerals. In the drawings.

DETAILED DESCRIPTION OF PREFERRED EMBODIMENTS

Figure 1:
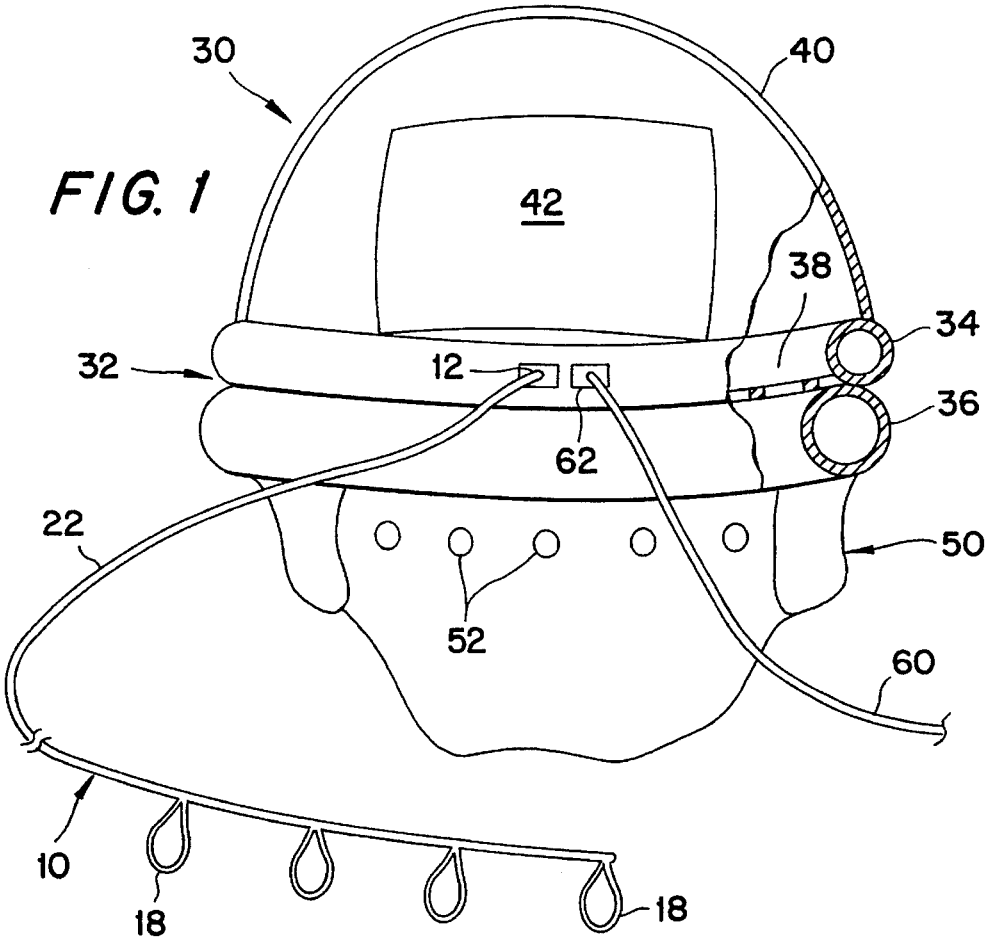
FIG. 1 is a side view of a life raft and survival tether apparatus according to the present invention, the raft being partially in section.

A life raft 30 having a survival link 10 in accordance with the present invention is illustrated in FIG. 1. The life raft is generally of the type disclosed in applicant's U.S. Pat. No. 4,001,905. The life raft 30 includes a flotation platform 32 comprising at least one, or, as illustrated two inflatable peripheral buoyant members 34, 36. A floor 38 is supported by the flotation platform 32 and is disposed in the space defined within the peripheral members 34, 36. The flotation platform 32 is covered by a canopy 40 to protect occupants of the life raft from weather. A door 42 provides access to the interior space under the canopy 40. A ladder (not illustrated) may be provided to assist boarding the raft 30 through the door 42.

A stabilizing bag 50 depends below the flotation platform 32. The stabilizing bag includes a plurality of holes 52 that allow the bag to fill with water when the life raft 30 is deployed. As described in U.S. Pat. No. 4,001,905, the stabilizing bag 50 helps maintain the life raft 30 in the desired upright orientation despite heavy seas or high winds that might otherwise overturn the raft.

A painter line 60 is attached to a patch 62 on a front point on the flotation platform 32 near the door 42. The patch 62 is attached to the flotation platform 32 in such a way that it releases, that is, breaks away, when a predetermined tension is reached in the painter line 60. The painter line 60 is also attachable at an opposite end (not illustrated) to the main vessel to keep the life raft 30 moored to the main vessel. As described in greater detail below, the painter line 60 is attached to a trigger device for automatically inflating the life raft.

A survival link 10 is also attached by a link 12 at a front point of the flotation platform 32. The survival link 10 comprises an elongated tether 14 having means 16 for securing at least one person to the tether.

The patch 62 attaching the painter line 60 the raft and the link 12 attaching the tether 14 to the raft are separate from each other, and the release of one line from the platform 32 does not effect the other. In the embodiment shown, which is for a relatively small raft for occupancy by four persons, the painter line 60 and tether 14 are attached to the flotation platform 32 adjacent to the door 42. Larger rafts, for example, those accommodating 10 or more persons, frequently have doors positioned at opposite sides of the canopy. In larger rafts it is advantageous to attach the painter line and the tether to opposite sides of the raft, that is, at each of the doors, to help prevent tangling of the painter line and the tether, and to allow use of the two lines for controlling the raft from the main vessel after it inflates.

In the embodiment shown in FIG. 1, the securing means 16 comprises at least one loop 18 attached at an end of the tether 14 remote from the attached end of the tether 14. Alternatively, the securing means 16 may comprise a hook, a harness member, or another suitable device. The embodiments of the securing means 16 are more fully described in connection with FIG. 3 and FIG. 4.

In practice, the securing means accommodates the capacity of the life raft 30. Using the example of FIG. 1, a four occupant raft is therefore provided with a tether having four loops 18.

Figure 2:
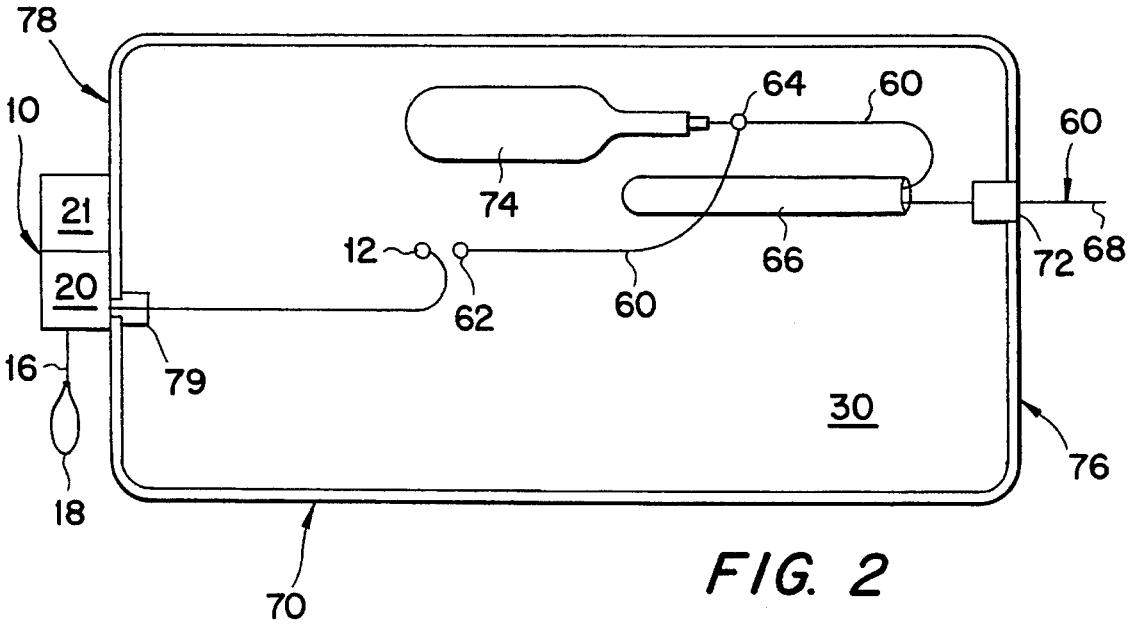
FIG. 2 is a schematic view of a life raft packed in a canister.

FIG. 2 is a schematic illustration of a life raft 30 packed in a canister 70, and ready for deployment. The painter line 60 is stored in the canister 70 and is attached to the raft 30 at the front point 62. An intermediate point of the painter line 60 is attached to a trigger 64 for an inflation means 74, in the embodiment shown, a compressed air cylinder. The painter line 60 triggers the automatic inflation means 64 when the line is pulled from the canister 70. The painter line 60 is gathered in a sleeve 66 to prevent fouling as it is pulled from the canister 70. A free end 68 of the painter line 60 extends from an opening 72 in a first end 76 of the canister, and is attachable to the main vessel (not illustrated) so that when deployed, the life raft 30 is tied to the main vessel. In the event the vessel begins to sink before the canister 70 can be thrown in the water to deploy the raft, the canister, which is buoyant, will float free of the vessel, and the painter line 60 will be pulled from the canister to trigger the inflation means 74. The raft 30 will then inflate clear of the vessel and out of the way of danger. The point at which the painter line 60 attaches to the main vessel, a so-called "weak link," is adapted to release or break away when a predetermined tension in the painter is reached to prevent the sinking main vessel from taking the life raft down with it. As mentioned, the patch 62 on the raft is designed also to release when predetermined tension is reached in the painter line 60. The patch 62, referred to as a "strong link," is generally designed to release at a tension greater than the release tension of the weak link on the vessel. The strong link will break away if, for example, the painter line becomes tangled with some object on the main vessel which prevents the weak link from freeing the raft from the vessel.

A painter line is generally formed 65 to 150 feet in length, depending on the size of the main vessel. Wind and waves can easily push the life raft 30 away from the main vessel the full length of the painter line 60, which creates difficulty for persons entering the water from the main vessel in reaching the life raft.

The survival link 10 is also packed with the life raft 30, but is stored in a container 20 disposed outside of the canister 70 and on a second side 78 opposite to the first side 76. Alternatively, the container 20 may be conveniently disposed in the canister 70. An opening 79 is provided in the canister to allow removal of the tether from the canister.

Positioning the survival link 10 to exit the canister 70 opposite from the painter line 60 helps to prevent the tether 14 and painter line from tangling when the life raft 30 is deployed. The tether 14 extends into the canister and is attached to the life raft 30 at the point 12, as described above. The majority of the tether 14 is stored in the external container 20 to be accessible before the life raft 30 is deployed. As illustrated, a loop 18 or another grippable portion of the survival link 10 extends from the container 20 for access. The survival link 10 is pulled from the container 20 while the canister is on board the main vessel.

In practice, when it becomes necessary to deploy the life raft 30, the survival link 10 is pulled from the storage container 20 and each of the persons who will board the life raft is secured to the tether 14 by the loops 18. The canister 70 is then thrown into the water, and, time permitting, the painter line 60 is manually pulled from the canister 70 to trigger inflation. The persons tethered to the life raft 30 can subsequently enter the water and use the tether 14 to pull themselves to the raft, without the danger of loosing contact with the raft because of rough water. Advantageously, the occupants linked on the tether 14 are also linked to each other, and would not be separated by the waves or currents. Those capable would be able to assist infants, non-swimmers, the injured, or others having difficulty in staying above the water and reaching the raft, increasing the margin of safety and survival of the passengers.

If necessary because of a dangerous condition on the main vessel, the persons may secure themselves to the tether 14, and may then enter the water with the canister 70 before the life raft 30 is inflated. The survival link 10 guarantees that the linked persons will be in contact with the inflated raft 30 despite conditions in the water.

Figure 3:
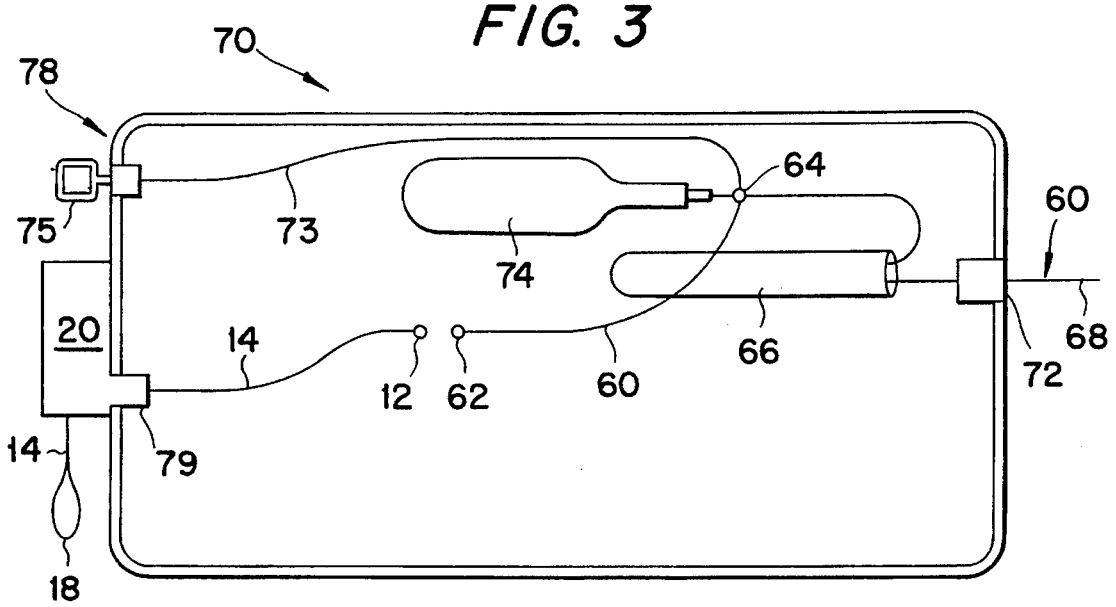
FIG. 3 is a schematic of the life raft canister illustrating an alternative embodiment of raft inflation triggering means.

According to another aspect of the invention, illustrated in FIG. 3, a secondary inflation trigger line 73 is connected to the inflation trigger 64. The trigger line 73 extends to the second side 78 of the canister 70 and is accessible by a handle 75. The trigger handle 75 provides means for a person in the water to conveniently activate the inflation of the raft without waiting for the painter line 60 to be pulled from the canister 70, or having to manually pull the painter line 60 while in the water, which can be difficult.

Figure 4:
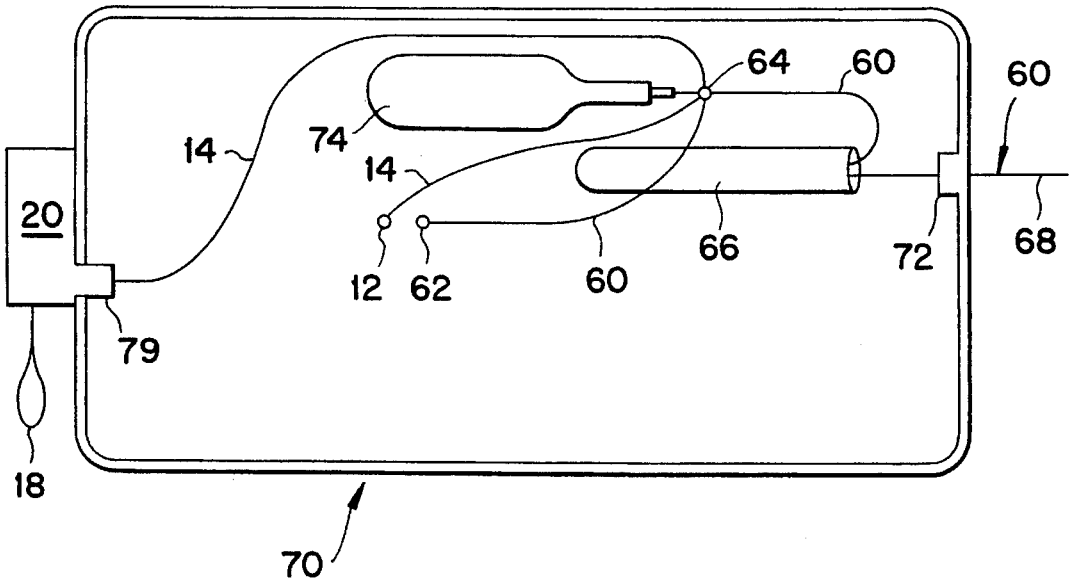
FIG. 4 is another schematic of the life raft canister illustrating another embodiment of the inflation triggering means.

FIG. 4 illustrates another inflation trigger scheme, for use with vessels such as motor-powered yachts, that pose little risk of damage to an inflating raft. According to FIG. 4, the tether 14, along with the painter line 60, is also connected to the trigger 64 for the inflation device 74. In the event the passengers are forced to enter the water before the life raft is inflated, the tether-linked trigger may be pulled from the canister and activated by a person secured on the tether, and the inflation device 74 triggered before it would be by the painter line 60. The painter line 60 connection to the 64 trigger would be available as a back-up system, operated by movement of the canister 70 relative to the main vessel, as explained above, or by manually pulling the painter line from the canister.

The redundant inflation triggers illustrated in FIG. 3 and FIG. 4 can be vital in situations where the painter line becomes fouled and cannot be pulled from the canister 70. Persons linked to the tether 14 would be able to trigger inflation while in the water, for example. In the event that the painter line both becomes fouled in the canister and becomes tangled on the main vessel, both the strong and weak links, designed to break away to free the raft from a sinking vessel, would be inoperative, and the vessel could take the raft canister under water with it. By triggering inflation of the raft 30 by a back-up system, the canister 70 opens and the painter line 60 is freed, which frees the strong point 62 to break away, if necessary.

The tether 14 may be manipulated to help right a raft that inflates upside down. The tether 14 is used to pull the raft to the main vessel and brace it against the hull. The tether 14 is then pulled to raise the unbraced side of the raft until it can be turned right side up. The painter line 60 can also be used to help position and maintain the raft against the vessel's hull.

Referring again to FIG. 1, a first portion 22 of the survival link 10 proximate to the link 12 is formed without securing means 18. The length of the first portion 22 is sufficient so that the life raft 30 may be deployed in the water while one or more persons remaining on the main vessel are linked to the tether 14. That is, the first portion 22 has sufficient length at least to clear the freeboard of the main vessel so that the raft 30 can ride in the water while the persons linked to the tether remain on the vessel. The raft 30 may thus be deployed without the necessity of the persons secured to the survival link 10 having to enter the water before they are ready to do so.

The loops 18 are mutually spaced apart a sufficient distance on the tether 14 to allow some freedom of movement to those secured to the tether for swimming and boarding the raft. Generally, about three feet between loops is provided, although other lengths would also be acceptable. The total length of the survival link 10 is less than the total length of the painter line 60 to facilitate control of the life raft 30 by the survival link 10 when the raft is deployed and to keep the persons secured to the tether 14 near the raft 30 after entering the water.

Figure 5:
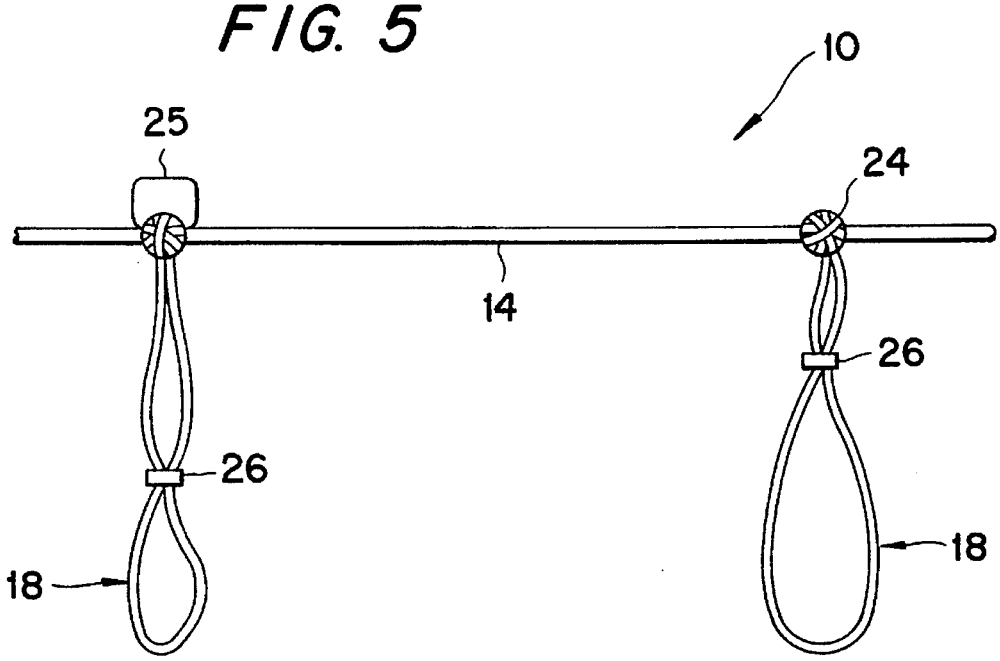
FIG. 5 is a plan view of linking means according to the present invention.
Figure 6:
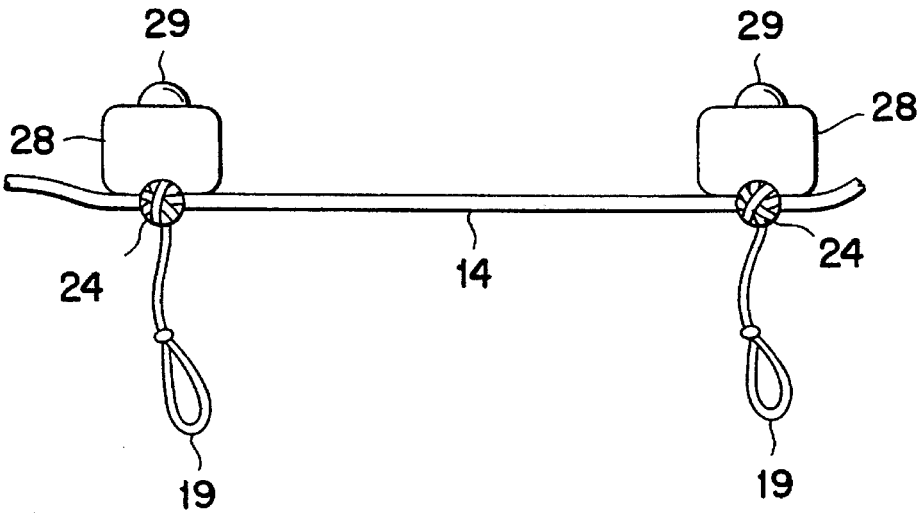
FIG. 6 is an alternative embodiment of linking means according to the present invention.

The preferred embodiments of the securing means 16 are illustrated in FIG. 5 and FIG. 6. The embodiment illustrated in FIG. 5 shows a loop 18 attached to the tether 14 by any convenient means, for example, a knot 24. The loop 18 is fitted with a slidable a collar 26 that allows adjustment of the opening of the loop to tighten the loop about a wrist. The loop 18 may alternatively be formed sufficiently large to be slipped over a person's head and shoulders to secure around the chest.

The survival link 14 may also include means 25 for releasing a shark or fish repellent into the water near the securing means 16 to protect persons secured to the tether 14 while in the water.

FIG. 6 is an alternative embodiment of the securing means 16 in accordance with the present invention. Hooks 19 are attached to the tether 14 by suitable means, for example, knots 24, as illustrated. The hooks 19 are any suitable self closing hook, for example, a snap hook. The hooks 19 are fastenable to a ring, and may conveniently be snapped onto a D-ring on a survival suit or life jacket. Alternatively, the securing means 16 may comprise a safety harness or another suitable device.

FIG. 6 illustrates additional features of the survival link 14 according to the present invention. Attached to the tether in conjunction with the securing means 16 are inflatable buoyant devices 28. The buoyant devices 28 may be triggered for inflation by pulling the tether 14 from the container 20 illustrated in FIG. 2. The buoyant devices 28 provide assistance to persons in the water to help stay afloat.

The survival link 14 may also include a signalling device 29 attached to the tether in conjunction with the securing means 16. The signalling device 29 may be a light, a radio signalling device, or a combination of them.

An auxiliary supply pack 21 is alternatively provided with the tether canister 20. The auxiliary supply pack 21 is a buoyant container for additional food rations, water, tools or other supplies that may be packed prior to a trip on the vessel to augment the supplies typically packed in the raft.

Figure 7:
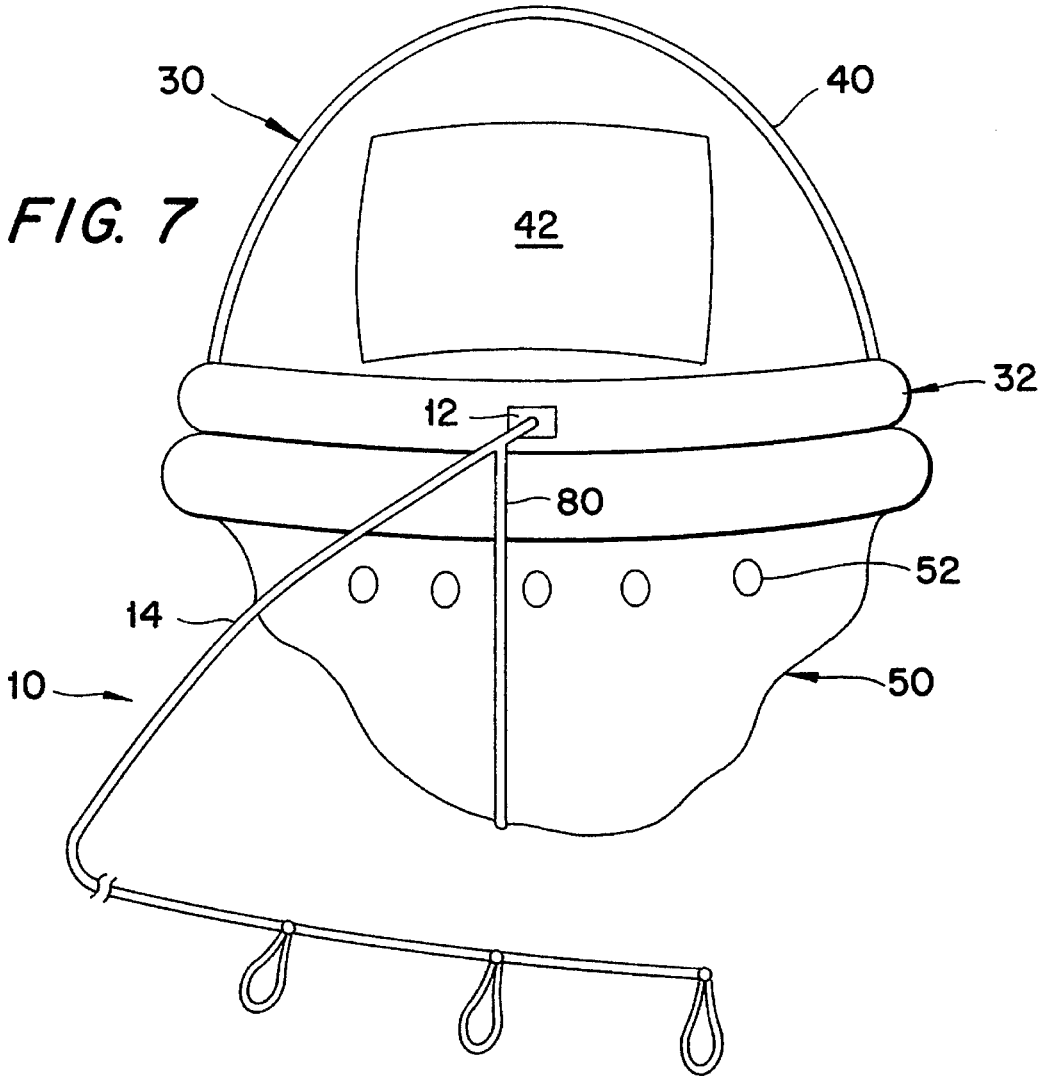
FIG. 7 is a side view of a life raft and survival tether equipped with a stabilizing bag control line in accordance with the present invention.

FIG. 7 illustrates an additional feature of the survival link 10 that cooperates with the stabilizing bag 50 to help control the life raft 30. Near the point 12 connecting the tether 14 to the life raft 30, a control line 80 is attached to the tether. The control line 80 extends from the tether 14 under and around the stabilizing bag 50 and attaches to the raft at a point opposite to the connecting point 12. The control line 80 may be positioned through loops provided in the bag 50 to maintain the control line in a desired location. Alternatively, the control line 80 may be attached directly to the stabilizing bag 50 at convenient points.

Figure 8:
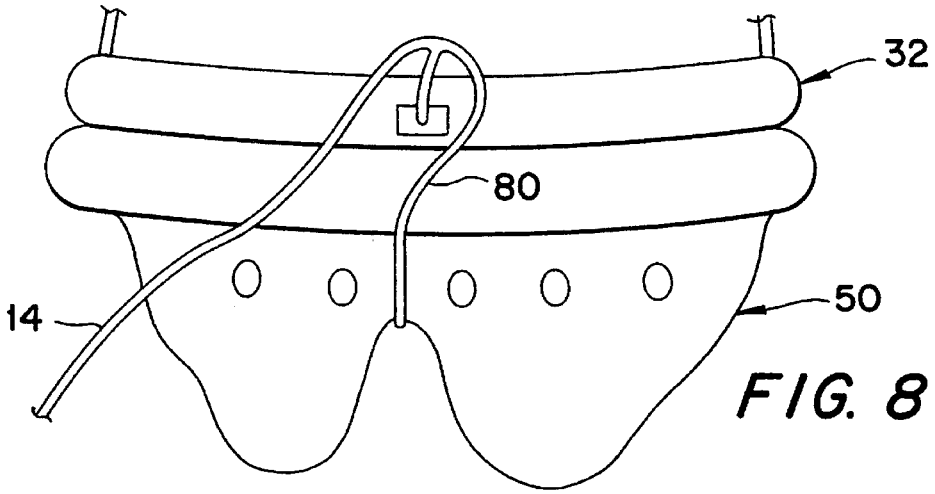
FIG. 8 is a view of a portion of the life raft of FIG. 7, illustrating the control line pulled up to an operative position.

As illustrated in FIG. 8, the control line 80 may be pulled upward toward the flotation platform 32 to pull the stabilizing bag 50 upward, and consequently, empty water from the openings 52 in the stabilizing bag 50. The stabilizing bag 50 takes a double-lobe shape with the control line 80 pulling on the center of the bag.

The control line 80 advantageously provides means for controlling for the effects of current and wind on the raft. When in the water, the stabilizing bag 50 is subject to the effects of current. As may be apparent, the canopy 40, extending upward from the flotation platform 32, acts as a sail, subjecting the life raft to the effects of wind. Wind on the canopy 40 will typically turn the door 42 to face into the wind. Occupants of the life raft 30 may, by emptying water from the stabilizing bag 50, reduce the effect of current on the raft and take advantage of a favorable wind. The double-lobe shape of the stabilizing bag 50 illustrated in FIG. 7, can act as a keel extending from the door 42 to the opposite side of the raft 30, and the raft can thus be "sailed" in a favorable wind.

Figure 9:
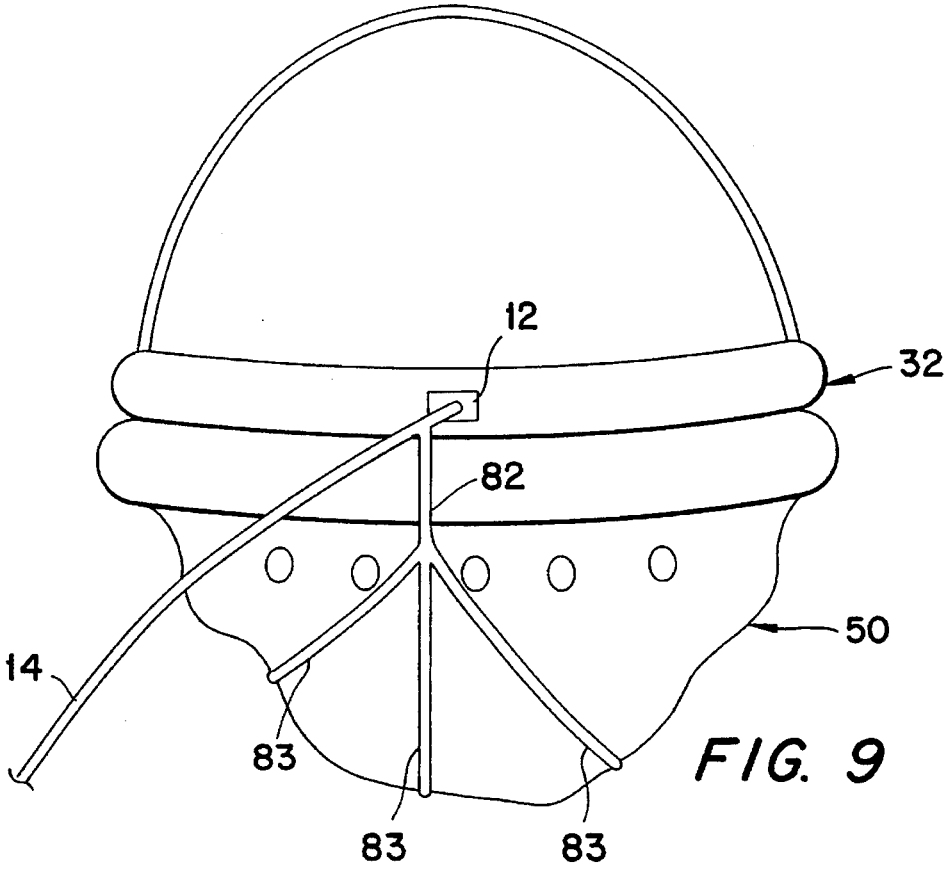
FIG. 9 is a side view of the life raft illustrating an alternative embodiment of the stabilizing bag control line.

FIG. 9 illustrates an alternative embodiment of a control line 82, comprising three support lines 83 extending from the tether 14 below the stabilizing bag 50, the support the three lines facilitating lifting and emptying the stabilizing bag 50. Preferably, the support lines 82 extend beneath the bag 50 through loops or similar devices and are attached on a side of the bag opposite to the door 42. Alternatively, the three support lines 83 of the control line 82 may comprise a web or net like structure covering a bottom portion of the stabilizing bag 50.

Figure 10:
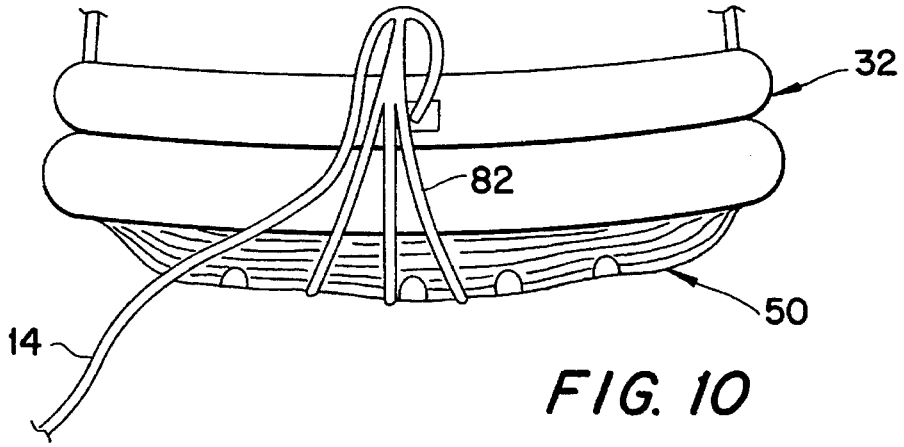
FIG. 10 is a view of a portion of the life raft of FIG. 9 illustrating the control line pulled up to a stabilization bag emptying position.

As shown in FIG. 10, the control line 82 may be lifted to empty water completely from the stabilizing bag 50. In this way, the raft will be entirely subject to the wind, and the current will have very little effect on the direction travelled by the raft.

As described in connection with FIG. 8, by lifting only the center support line of the control line 82, the stabilizing bag 50 may be shaped in a double-lobed keel for "sailing" the raft in the current and wind.

The ability of the occupants of the raft 30 to control the stabilizing bag 50 to take advantage of wind and currents can be an important factor in rescue situations. By the time a rescue vessel or aircraft arrives at the scene, a raft may be many miles distant from the site of the distress call. Drift rate and other calculations can only estimate the position of the raft within a wide search area, and much valuable time must be spent in searching the area. The survivors in a raft according to the present invention have the ability to use the control line to take advantage of wind and current to move the raft in the direction of search vessels or aircraft they may see or hear.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed is:

1. A survival apparatus for a life raft, comprising:

a flotation platform for carrying at least one life raft occupant, the flotation platform comprising a peripherally disposed buoyant member and a floor spanning an interior space bounded by the buoyant member, the floor being supported thereby;

a stabilizing bag depending below the flotation platform, the stabilizing bag having a plurality of openings to fill with water when the flotation platform is deployed;

an elongated tether attached by a first end to an external surface of the flotation platform, the tether having linking means for securing at least one person to the tether, said linking means being spaced a predetermined distance from the first end, said tether being accessible without the necessity of deploying the life raft; and, a control line attached at an upper end to the tether adjacent the first end and extending below the stabilizing bag to an opposite side of the flotation platform, the control line attached to one of the stabilizing bag and the flotation platform, wherein lifting the control line forces water from the stabilizing bag through the openings in the stabilizing bag.

2. The apparatus as claimed in claim 1, wherein the linking means comprises at least one adjustable loop that is tightenable to secure a person to the elongated tether.

3. The apparatus as claimed in claim 2, wherein the linking means comprises a plurality of adjustable loops spaced apart on the tether, the loops being cinchable about a part of a person.

4. The apparatus as claimed in claim 1, wherein the linking means comprises at least one closable hook.

5. The apparatus as claimed in claim 1, wherein the predetermined distance the linking means is spaced from the first end of the tether provides a sufficient length of the tether to permit the canister to be deployed in the water when at least one person on a main vessel is linked to the tether.

6. The apparatus as claimed in claim 1, wherein the control line comprises at least two spaced apart support lines extending below the stabilizing bag.

7. The apparatus as claimed in claim 1, wherein the control line further comprises a webbing extending below the stabilizing bag to distribute upward force by the control line across a lower surface of the stabilizing bag.

8. The apparatus as claimed in claim 1, wherein the flotation platform is inflatable and when uninflated is storable in a confined condition, the elongated tether being accessible when the flotation platform is in the confined condition.

9. The apparatus as claimed in claim 1, further comprising an inflatable device attached to the elongated tether in conjunction with the linking means to support a person in the water.

10. The apparatus as claimed in claim 1, further comprising a signalling device attached to the elongated tether in conjunction with the linking means.

11. The apparatus as claimed in claim 1, further comprising releasable shark repellent means attached to the tether in conjunction with the linking means.

12. The apparatus as claimed in claim 1, further comprising a buoyant container attached to the elongated tether for storage.

13. An inflatable life raft safety apparatus, comprising:

a hollow canister having a front end and an opposite rear end;

an inflatable life raft contained within the canister, the life raft including at least an inflatable flotation platform for carrying at least one life raft occupant, the flotation platform comprising a peripheral buoyant member and a floor spanning an interior space bounded by the peripheral buoyant member when inflated, the floor being supported thereby, and a stabilizing bag positionable below the flotation platform when inflated, the stabilizing bag having a plurality of openings to fill the stabilizing bag with water;

means for inflating the life raft, including a line having a first end and a second end, the first end attached to the flotation platform and the second end extending from the first end of the canister and attachable to a vessel, an intermediate point of the line attached for triggering a compressed gas source to inflate the life raft, the line having a predetermined stored length that is pulled from the canister before the compressed gas source is triggered; and, a tether attached to the flotation platform at a first end and having a free second end, the tether extending from a rear end of the canister and having a predetermined length, the tether having means for securing at least one person to the tether;

wherein, upon deployment of the life raft, at least one person is secured to the tether so that when the life raft inflates in the water, the person is linked to the life raft.

14. The apparatus as claimed in claim 13, wherein the means for securing at least one person to the tether comprises a plurality of spaced apart adjustable loops for cinching about a body part of a person.

15. The apparatus as claimed in claim 13, wherein said means for securing a person to the tether is spaced from the first end of the tether a sufficient distance to provide a length of the tether sufficient to permit the canister to be deployed in the water while at least one person on a deploying vessel is secured to the tether.

16. The apparatus as claimed in claim 13, wherein the means for securing at least on person to the tether comprises a plurality of spaced apart snap hooks for attaching to a ring on a survival suit.

17. The apparatus as claimed in claim 13, further comprising an inflatable device attached to the elongated tether in conjunction with the linking means to support a person in the water.

18. The apparatus as claimed in claim 13, further comprising a lighting signal device attached to the elongated tether in conjunction with the linking means.

19. The apparatus as claimed in claim 13, further comprising releasable shark repellent means attached to the tether in conjunction with the linking means.

20. The apparatus as claimed in claim 13, further comprising a buoyant container attached to the elongated tether for storage.

21. The apparatus as claimed in claim 13, further comprising a control line attached at an upper end to the tether adjacent the first end, the control line attached to one of a lower portion of the stabilizing bag and the flotation platform, wherein lifting the control line forces water from the openings in the stabilizing bag.

22. The apparatus as claimed in claim 21, wherein the control line further comprises a webbing attached to the stabilizing bag to distribute upward force by the control line across a lower surface of the stabilizing bag.

23. The apparatus as claimed in claim 21, wherein the control line comprises at least two spaced apart support lines extending below the stabilizing bag and attached to one of a lower portion of the stabilizing bag and the flotation platform.

24. The apparatus as claimed in claim 13, further comprising means linking the tether for triggering the compressed gas source for inflating the raft.

25. The apparatus as claimed in claim 13, further comprising a trigger line attached for triggering the compressed gas source, the trigger line accessible externally of the canister.

* * * * *